United States Patent [19]

Briens et al.

[11] 4,406,771

[45] Sep. 27, 1983

[54] SOLVENT DEWAXING WAXY HYDROCARBON OIL DISTILLATES USING A COMBINATION POLY DI-ALKYL FUMARATE-VINYL ACETATE COPOLYMER HAVING PENDENT CARBON SIDE CHAIN LENGTH OF PREDOMINANTLY $C_{22}$ AND POLYALKYL(METH-)ACRYLATE POLYMER DEWAXING AID

[75] Inventors: Cedric L. Briens, Richmond; Bruce M. Sankey, Sarnia, both of Canada

[73] Assignee: Exxon Research and Engineering Co., Florham Park, N.J.

[21] Appl. No.: 426,680

[22] Filed: Sep. 29, 1982

[51] Int. Cl.[3] ..... C10G 73/04

[52] U.S. Cl. ..... 208/33

[58] Field of Search ..... 208/33

[56] References Cited

U.S. PATENT DOCUMENTS

| | | | |
|---|---|---|---|
| 2,798,027 | 7/1957 | Cohen | 196/19 |
| 3,239,445 | 3/1966 | Leonard et al. | 208/33 |
| 3,262,873 | 7/1966 | Tiedje et al. | 208/33 |
| 3,458,430 | 7/1969 | Henselman et al. | 208/33 |
| 3,475,321 | 10/1969 | Henselman | 208/33 |
| 3,479,278 | 11/1969 | DeVault | 208/33 |
| 3,729,296 | 4/1973 | Miller | 44/62 |
| 3,806,442 | 4/1974 | Reid et al. | 208/33 |
| 3,854,893 | 12/1974 | Rossi | 44/62 |
| 4,088,589 | 5/1978 | Rossi et al. | 252/56 |
| 4,153,423 | 5/1979 | Wisotsky | 44/62 |
| 4,191,631 | 3/1980 | Grisham | 208/33 |

FOREIGN PATENT DOCUMENTS

| | | | |
|---|---|---|---|
| 1248201 | 8/1967 | Fed. Rep. of Germany . | |
| 1248203 | 8/1967 | Fed. Rep. of Germany . | |
| 2113780 | 6/1972 | France . | |
| 45-44516 | 5/1970 | Japan . | |
| 45-122276 | 12/1970 | Japan . | |
| 45-122277 | 12/1970 | Japan . | |
| 52-44261 | 4/1977 | Japan . | |
| 52-77382 | 6/1977 | Japan . | |
| 945828 | 10/1961 | United Kingdom | 208/33 |
| 930968 | 7/1963 | United Kingdom . | |
| 1145427 | 3/1969 | United Kingdom | 208/33 |
| 1151385 | 5/1969 | United Kingdom . | |
| 810668 | 12/1978 | U.S.S.R. . | |

*Primary Examiner*—Delbert E. Gantz
*Assistant Examiner*—Glenn A. Caldarola
*Attorney, Agent, or Firm*—Joseph J. Allocca

[57] ABSTRACT

This invention relates to processes for solvent dewaxing waxy hydrocarbon oil distillates employing a dewaxing aid which dewaxing aid is a mixture of (a) poly(meth-)acrylate polymers and (b) polydialkylfumarate/vinyl acetate copolymers. The dewaxing aid mixture is selected from the group of mixtures consisting of a mixture of (a) poly(meth-)acrylate polymer which is an ester of a $C_{10}$ to $C_{22}$ aliphatic alcohol with acrylic or methacrylic acid and has a number average molecular weight greater than about 5,000 and (b) polydialkylfumarate/vinyl acetate copolymer wherein the pendent alkyl side chain group contains from 16–30 carbon atoms but is primarily i.e. >50% $C_{22}$ (preferably behenyl), and the component (B) has a number average molecular weight of about 1,000 to 100,000, preferably about 5,000 to 50,000. The combination (a) plus (b) may be employed in a weight ratio within the range of from about 100/1 to 1/100, preferably about 8/1 to 1/4, more preferably about 8/1 to 1/1 most preferably about 3/1 a/b, and at an aid dose level ranging from about 0.01 to 1 wt. %, preferably between about 0.02 to 0.2 wt. % active ingredient.

The solvent dewaxing of bright stocks can also be benefitted by using as a dewaxing aid a combination consisting of component B recited above and a component A which is a polymethacrylate copolymer having an average pendent carbon side chain length of predominantly i.e. >50% $C_{16}$ and higher.

13 Claims, 1 Drawing Figure

INFLUENCE OF POLYDIALKYLFUMARATE VINYLACETATE/
ALKYL METH ACRYLATE CONCENTRATION
RATIO ON THE FEED FILTER RATE AND THE DEWAXED OIL YIELD

Incremental Dilution 600N oil (Total Dewaxing Aid Concentration: 0.1 Wt % as received on Feed)

SOLVENT DEWAXING WAXY HYDROCARBON OIL DISTILLATES USING A COMBINATION POLY DI-ALKYL FUMARATE-VINYL ACETATE COPOLYMER HAVING PENDENT CARBON SIDE CHAIN LENGTH OF PREDOMINANTLY $C_{22}$ AND POLYALKYL(METH-)ACRYLATE POLYMER DEWAXING AID

DESCRIPTION OF THE INVENTION

This invention relates to processes for solvent dewaxing waxy hydrocarbon oil distillates employing a dewaxing aid which dewaxing aid is a mixture of (A) polyalkyl(meth-)acrylate polymer (preferably a polymethacrylate polymer) which is an ester of aliphatic alcohols of 10–22 carbons in length, excluding branching (predominantly $C_{12}$–$C_{18}$ aliphatic alcohol) with acrylic or methacrylic acid (preferably methacrylic acid) and has a number average molecular weight greater than about 5,000 and (B) polydialkylfumarate/-vinyl acetate copolymer wherein the pendent alkyl side chain groups are from 16–30 carbon atoms in length (excluding branching) but is primarily (i.e. >50%) $C_{22}$ (preferably the pendent alkyl side chain groups are substantially linear, i.e. little or no branching), and the component (B) has a number average molecular weight of about 1,000 to 100,000 preferably about 5,000 to 50,000. Typical of poly di-n-alkyl-fumarate/vinyl acetate useful in the present invention is behenylfumarate/-vinyl acetate. The combination (a) plus (b) may be employed in a weight ratio within the range of from about 100/1 to 1/5, preferably about 8/1 to 1/4, more preferably about 8/1 to 1/1 most preferably about 3/1 a/b, and at an aid dose level ranging from about 0.01 to 1 wt.% active ingredient, preferably between about 0.02 to 0.2 wt.% active ingredient.

This dewaxing aid combination aids in solvent dewaxing processes wherein a waxy hydrocarbon oil distillate is mixed with a normally liquid dewaxing solvent and a quantity of the recited dewaxing aid combination to form a mixture which is chilled either directly using cold dewaxing solvent or indirectly in heat exchange apparatus to form a slurry comprising wax particles and a solution of dewaxed oil and dewaxing solvent. The dewaxing aid components (a) and (b) may be precombined one with the other for addition to the waxy oil distillate to be dewaxed, either as such or diluted in a suitable wax-free oil to improve flow properties. Alternatively, the components may be added separately and simultaneously or separately and sequentially at the same or separate points within the process. Even in this embodiment the individual components (a) and (b) may be employed as such or diluted in a suitable wax-free oil to improve flow properties. The wax particles which are precipitated are subsequently separated from the dewaxed oil by any of a number of typical liquid/solid separation processes exemplified by, but not limited to, filtration, settling, centrifugation, etc.

The use of the combination (a) plus (b) results in increased separation rates as compared to using no aid at all or using either component individually.

BACKGROUND OF THE INVENTION

Waxes in wax-containing hydrocarbon oils are removed therefrom by chilling the oil to precipitate out the wax and then separating the solid wax particles from the dewaxed oil by solid/liquid separation procedures such as filtration, centrifugation, settling, etc. Industrial dewaxing processes include press dewaxing processes wherein the wax-containing oil, in the absence of solvent, is chilled to crystallize out the wax particles, which are then pressed out by a filter. In general, only light hydrocarbon oil fractions are treated by press dewaxing processes due to viscosity limitations. More widely used are solvent dewaxing processes wherein a waxy oil is mixed with a solvent and then chilled to precipitate the wax as tiny particles or crystals thereby forming a slurry comprising solid wax particles and a solution of dewaxed oil containing dewaxing solvent. The slurry is then fed to a wax separator (e.g. filter) wherein the wax is removed from the dewaxed oil and dewaxing solvent. Solvent dewaxing processes are used for heavier oil fraction such as lubricating oil fractions and bright stocks. Typical dewaxing solvents include low boiling point, normally gaseous autorefrigerative hydrocarbons such as propane, propylene, butane, pentane, etc., ketones such as acetone, methyl ethyl ketone (MEK), methyl isobutyl ketone (MIBK) and mixtures thereof, aromatic hydrocarbons such as benzene, toluene and xylene as well as mixtures of ketones and aromatic hydrocarbons such as MEK/toluene and acetone/benzene and mixtures of ketones with autorefrigerants such as acetone/propylene.

One of the factors tending to limit the capacity of a solvent dewaxing plant is the rate of wax filtration (and separation in general) from the dewaxed oil, which in turn is strongly influenced by the crystal structure of the precipitated wax. Although the crystal structure of the precipitated wax is influenced by various operating conditions in the dewaxing process, for any given feed it is most strongly influenced by the chilling conditions. The size and crystal structure of the precipitated wax, occlusion of oil in the wax crystal and the condition of the oil left in the crystal are extremely varied and depend on the wax composition and precipitation conditions. These conditions also affect the separation (filtration) rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil.

One way of improving the filtration rate and minimizing haze formation is to add a dewaxing aid to the wax containing oil during the dewaxing process.

PRESENT INVENTION

Figure 1:
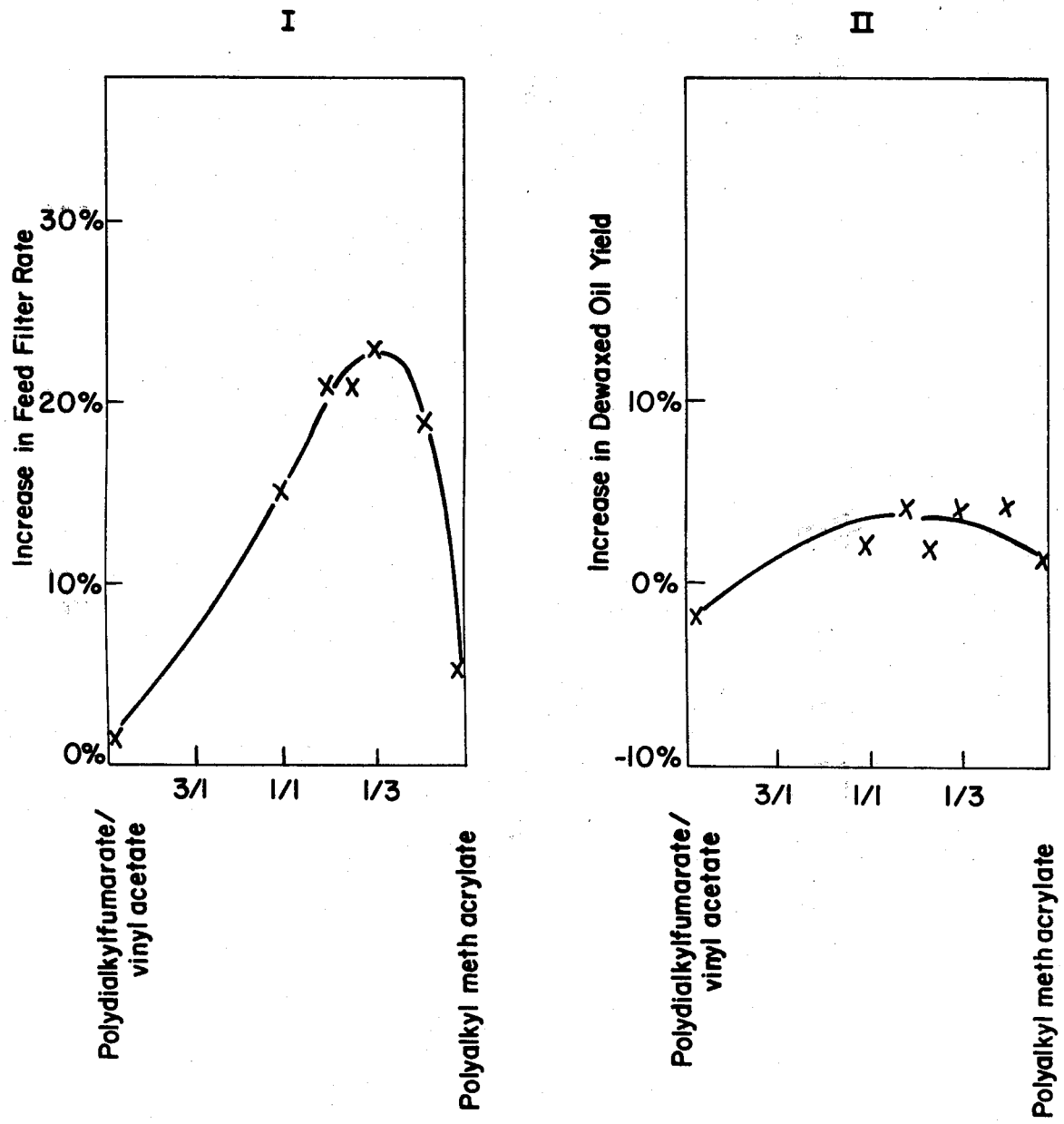
FIG. 1 (I and II) presents the influence of the concentration of the combination dewaxing aid used in the present invention on the feed filter rate and on the dewaxed oil yield.

This invention relates to processes for solvent dewaxing waxy hydrocarbon oil distillates employing a dewaxing aid which dewaxing aid is a mixture of (a) polyalkyl(meth-)acrylate polymers and (b) polydialkylfumarate/vinyl acetate copolymers. The dewaxing aid mixture is a mixture of (a) polyalkyl (meth-)acrylate polymer (preferably polyalkyl methacrylate polymer) which is an ester of aliphatic alcohols of 10–22 carbons in length, excluding branching (predominantly $C_{12}$–$C_{18}$ aliphatic alcohols) with acrylic or methacrylic acid (preferably methacrylic acid) and has a number average molecular weight greater than 5,000 and (b) polydialkylfumarate/vinyl acetate copolymer wherein the pendent alkyl side chain groups contain from 16–30 carbon atoms in length (excluding branching) but is primarily (i.e. >50%) $C_{22}$, (preferably the pendent alkyl side chain groups are substantially linear, i.e. little or no branching), and the component (B) has a number average molecular weight of about 1,000 to 100,000 preferably 5,000 to 50,000. The combination (a) plus (b) may be employed in a weight ratio within the range of from about 100/1 to 1/5, preferably about 8/1 to 1/4, more preferably about 8/1 to 1/1 most preferably about 3/1 a/b, and at an aid dose level ranging from about 0.01 to 1 wt.% active ingredient, preferably between about 0.02 to 0.2 wt.% active ingredient.

This dewaxing aid is advantageously employed as separately prepared components (a) and (b). These components may then be mixed together in the previously recited ratios and added at the desired dose level, either as such or dissolved in a suitable wax-free oil such as mineral oil or other suitable solvent such as toluene, benzene, propane, methylene chloride and the like which imparts to the additive improved flow properties, pumpability, etc. Alternatively, the individual components (a) and (b) can be employed separately (either as such or dissolved in a solvent as previously indicated) and introduced to the dewaxing process simultaneously or sequentially at separate points within the process. The aid, regardless of whether both components are pre-mixed one with the other, or employed separately/simultaneously or separately/sequentially with or without dilution, may be either mixed with the waxy oil prior to chilling, or introduced during the chilling process in either indirect chilling means, such as scraped surface chillers, or alternatively, direct chilling means employing cold solvent. Preferred direct chilling means employing cold solvent injected along a number of stages therein a number of which stages are highly agitated insuring instantaneous mixing is the DILCHILL® (registered service mark of Exxon Research and Engineering Company) process as presented in U.S. Pat. No. 3,773,650, hereby incorporated by reference.

The dialkylfumarate of component (b) has alkyl group side chains of from 16 to 30 carbon atoms in length, the pendent side chain length being predominantly (i.e. >50%) $C_{22}$. Preferably the dialkylfumarate is behenyl fumarate. The component (b) copolymer has a number average molecular weight greater than 5,000. U.S. Pat. No. 3,729,296 describes polydialkylfumarate/vinyl acetate copolymers in general and behenyl fumarate/vinyl acetate copolymers in particular (which satisfies the requirements of component (b) of this invention) and a method for preparing them.

The polymer of the ester of an aliphatic alcohol with methacrylic or acrylic acid preferably methacrylic acid used as component (a) is a polymer of an ester of aliphatic alcohols of from about 10 to 20 carbon atoms in chain length predominantly $C_{12}$–$C_{18}$ aliphatic alcohols. The polymer will have a number average molecular weight greater than about 5,000. Preferred commercial (meth)-acrylic-ester polymers having the needed characteristics for use in this invention are Acryloid 144 and Acryloid 150 available from Rohm and Haas Company. Acryloid 144 is described as having an average side chain length of predominantly $C_{16}C_{18}$ (>50% $C_{16}$ and higher) and a number average molecular weight of about 5,000 to 200,000 preferably 10,000 to 100,000. Acryloid 150 is described as having an average side chain length of predominantly $C_{14}$ and lower (>50% and $C_{14}$ and lower) and a number average molecular weight of about 5,000 to 200,000 preferably 10,000 to 100,000. Commercial acrylic ester polymers are available from Shell Oil Company.

Samples of materials representative of those (both within the scope and outside the scope of the present invention) employed in the Examples of this specification were examined and were determined to have the following characteristics.

A representative poly di-n-alkyl fumaratevinyl acetate copolymer having predominantly $C_{20}$ pendent alkyl side chains (~63% $C_{20}$, ~25% $C_{22}$, ~12% Other) possessed a number average molecular weight of about 26,400 and a weight average molecular weight of about 110,000 with a 10–90 mole % number average molecular weight of about 5,000 to 70,000.

A representative poly di-n-alkyl fumaratevinyl acetate copolymer having predominantly $C_{22}$ pendent alkyl side chains (behenyl side chains) (~70% $C_{22}$, ~15% $C_{20}$, ~15% $C_{18}$) possessed a number average molecular weight of about 8,600 and a weight average molecular weight of about 60,900, with a 10–90 mole % number average molecular weight of about 1,000 to 20,000.

A representative poly alkyl meth-acrylate copolymer of the type identified as Acryloid 150 having predominantly $C_{12}$–$C_{16}$ pendent alkyl side chains (2% $C_{10}$, 30% $C_{12}$, 27% $C_{14}$, 14% $C_{16}$, 16% $C_{18}$, 11% $C_{20}$) possessed a number average molecular weight of about 62,200 and a weight average molecular weight of about 284,000, with a 10–90 mole % number average molecular weight of about 5,000 to 20,000.

A representative poly alkyl methacrylate copolymer of the type identified as Acryloid 144 having predominantly $C_{16}$–$C_{18}$ pendent alkyl side chains (4% $C_{12}$, (and lower) 7% $C_{14}$, 39% $C_{16}$, 45% $C_{16}$, 45% $C_{18}$, 5% >$C_{20}$) possessed a number average molecular weight of about 33,300, a weight average molecular weight of about 205,800, with a 10–90 mole % number average molecular weight of about 5,000 to 75,000.

Molecular weights were determined by gel permeation chromatography calibrated on polystyrene.

While the samples presented above were not the exact samples employed in the Examples of the present specification, it is believed they are fairly representative of such samples and serve to demonstrate the general characteristics of materials which satisfy the requirement of the present invention, as well as of those which do not so satisfy those requirements.

The dewaxing solvent that is used in the present invention is not particularly critical; thus, any of the well-known dewaxing solvents can be used. For example, ketones having from 3 to 6 carbon atoms, such as acetone, dimethyl ketone, methyl ethyl ketone, methyl propyl ketone and methyl isobutyl ketone and mixtures thereof, aromatic hydrocarbons such as benzene, xylene or toluene, mixtures of ketones and aromatic hydrocarbons such as methyl ethyl ketone/toluene or methyl isobutyl ketone/toluene. Also useful are halogenated hydrocarbons such as methylene chloride. Further, N-alkylpyrrolidones such as N-methyl-pyrrolidone and N-ethyl-pyrrolidone may be used as components of the dewaxing solvent. Solvents which may be especially preferred for practicing the process of the present invention include aromatic hydrocarbons such as toluene, $C_5$–$C_6$ ketones such as MEK, MIBK and mixtures thereof, mixtures of a ketone and an aromatic hydrocarbon such as MEK/toluene, halogenated hydrocarbons such as methylene chloride, and mixtures of acetone and methylene chloride.

The waxy oils treated by the process of the present invention employing the above-recited dewaxing aids are waxy oils derived from distillates boiling predominantly within the range of 300° C. to 600° C., have a density of 0.80–0.90 g/cc @ 15° C., have a viscosity of 3–12 @ cSt/100° C., have a pour point of 30°–50° C. and a dry wax content of 10–25 wt%. A typical 600 N distillate has a boiling range of 400°–550° C., a density of 0.8745 g/cc @ 15° C., a viscosity of 10.1 cSt/100° C., a pour point of 50° C. and a dry wax content of 21 wt%.

These distillates can be obtained from any convenient source such as paraffinic crudes (Aramco, Kuwait, the Panhandle, North Louisiana, etc.) naphthenic crudes (Tia Juana, Coastal, etc.), bright stocks and synthetic feedstocks such as derived from tar sand oils, heavy crude oil, shale oil, coal oils, etc.

The most preferred stocks are the distillate cut fractions which include lubricating oils and specialty oil fractions boiling within the range of 300° to 600° C.

In one instance it has also been discovered that the solvent dewaxing of a bright stock can be enhanced by the use of a dewaxing aid combination within the scope of the present invention. Bright stocks are oils typically boiling in the range of about 500°–700° C., with densities of from about 0.85–0.92 g/cc @ 15° C., viscosities of about 25–37 cSt/100° C., pour point of about 60°–70° C. and a dry wax content of about 15–25 wt% for about −9° C. pour point and a Conradson carbon residue value of about 0.3–2.0. A typical bright stock, Arab Light 2500 N has a boiling point of from about 500°–700° C., a density of 0.89 g/cc @ 15° C., a viscosity of 32 cSt/100° C., a pour point of 65° C. and a dry wax content of 16 wt%. Preferably the bright stock is a lube oil or specialty oil fraction. The particular dewaxing aid combination which demonstrates utility in this bright stock dewaxing consists of component (B), as previously described, in combination with a preferred component (A), a methacrylic ester polymer having pendent side chain group lengths of between 10°–22° C. predominantly $C_{16}$ and higher as exemplified by Acryloid 144 (see Example 4).

This solvent dewaxing of a bright stock involving the use of the above recited specific subset of dewaxing aid components A and B within the general ranges previously recited in this specification, is viewed as comprising part of the present invention.

In an embodiment of the process of this invention, a solution of dewaxing aid comprising components (a) and (b) dissolved in an appropriate solvent such as a light heating oil or a light dewaxed mineral oil fraction is mixed into the wax-containing oil and the mixture heated to a temperature higher than the cloud point of the oil (typically about 50° to 120° C.). This mixture is introduced, along with the dewaxing solvent, into a chilling zone and chilled to a temperature necessary to yield the desired pour point for the resulting dewaxed oil. The chilling produces a slurry comprising dewaxed oil and solvent along with solid particles of wax which contain the dewaxing aid. This slurry is then sent to wax separation means, typically a wax filter to separate the dewaxed oil and solvent from the wax particles. The dewaxing temperature or temperature to which the slurry is chilled varies depending on the feed and conditions. In general, this temperature will range from about 0° to about −50° C. In the case where the dewaxing solvent comprises a mixture of a ketone and an aromatic hydrocarbon, such as methyl ethyl ketone/toluene, the dewaxing temperature will range from about −10° to about −30° C.

Preferred dewaxing solvents used in the process of this invention include mixtures of a ketone and an aromatic hydrocarbon as well as a mixture of a ketone and methylene chloride. The ratio of solvent to waxy oil would generally range from about 0.5 to 10 and preferably from about 2 to 7, by volume. The optimum amount of dewaxing solvent employed is, of course, determined by the wax content of the oil, viscosity, pretreatment and dewaxing conditions.

EXAMPLE 1

A waxy 600 N distillate with a boiling range of about 400°–500° C. and a viscosity of 10.1 cSt at 100° C. was dewaxed in a bench scale vertical scraper. It comprised a 13 cm ID steel cylinder which was 30 cm high. The walls were scraped by two vertical aluminum blades which were attached to a central shaft rotating at 28 rpm. Chilling of the scraper contents was accomplished by immersion in a refrigerant bath. The chilling rate of the scraper contents was about 5° C./min.

The dewaxing aid combination to be tested (which had already been mixed) was added at about 70° C. to the waxy feed to give the specified treat rate. The treated feed was then mixed with the predilution solvent and introduced into the scraper. The mixture was then chilled progressively and the solvent increments were added at appropriate temperatures. When the filtration temperature (about −10° C.) was reached, the scraper was removed and the filtration performance of the wax slurry was measured with a small vacuum leaf filter at a vacuum of 12 in. Hg.

The solvent used in this example was a 45/55 mixture of methyl ethyl ketone and methyl isobutyl ketone. The dilution ratio at filtration was 2.5 volumes of ketone solvent per volume of waxy feed.

A commercial example of dewaxing aid component (b) (B-1: a behenyl fumarate/vinyl acetate copolymer) was used in combination with a commercial example of dewaxing aid component (a) (Acryloid 144 from Rohm and Haas, a methacrylic ester previously described). The dewaxing aid concentrations are given on an "as received" basis. (The amount of Active Ingredient (A.I.) present in materials representative of the types employed in the examples are typically as follows: materials representative of Component B-1 are about 45 wt.% A.I.; materials representative of the Acryloid 144 sample are about 27 wt.% A.I.). Table 1 shows the results obtained with dewaxing aid concentrations of 0.1 wt.% and 0.2 wt.% on feed (as received) and shows the synergistic effect which is observed when components (a) and (b) are combined. These data are presented graphically in FIG. 1.

COMPARATIVE EXAMPLE

A dewaxing aid combination of a polydialkylfumarate/vinyl acetate copolymer (B-2) outside the scope of the present invention and Acryloid 150 (previously described) was also tested. The waxy oil, the equipment and the experimental procedure were identical to those of the previous example. The dewaxing aid components are used in an "as received" form. (Again, materials representative of the types employed as dewaxing aids in the examples typically have active ingredient concentrations as follows; materials representative of Component B-2 are about 37 wt.% A.I.; materials representative of the Acryloid 150 sample are about 38 wt.% A.I.).

Polydialkylfumarate/vinyl acetate copolymers B-1 and B-2 are described below in terms of pendent alkyl side chains:

B-1: 15% $C_{18}$, 15% $C_{20}$, 70% $C_{22}$.

B-2: 63% $C_{20}$, 25% $C_{22}$, 12% Other.

They are prepared by copolymerizing vinyl acetate with dialkylfumarate, following the procedure generally described in U.S. Pat. No. 3,729,296. The characteristic which significantly differentiates between the two is their respective average pendent side chain lengths.

At a 0.1 wt% on feed (as received) treat level on 600 N distillate, a 3/1 mixture of Acryloid 150 and B-2 gave no significant increase in filter rate whereas a 3/1 mixture of Acryloid 144 and B-1 gave a 23% increase in filter rate.

TABLE 1

EVALUATION OF DEWAXING AID MIXTURES USING 600N DISTILLATE (10.1 cSt at 100° C.)

| Dewaxing Aid Mixtures | DWA DWA Concentration (Wt. % as Received) | Improvement in Feed Filter Rate | Change in Dewaxed Oil Yield |
|---|---|---|---|
| A Single Components | | | |
| B-1 | 0.1 | 1% | −2% |
| Acryloid 144 | 0.1 | 5% | +1% |
| B Mixed Components | | | |
| B-1 | 0.05 | 44% | +4% |
| Acryloid 144 | 0.15 | | |
| B-1 | 0.05 | 15% | +2% |
| Acryloid 144 | 0.05 | | |
| B-1 | 0.038 | 21% | +4% |
| Acryloid 144 | 0.062 | | |
| B-1 | 0.031 | 21% | +2% |
| Acryloid 144 | 0.069 | | |
| B-1 | 0.025 | 23% | +4% |
| Acryloid 144 | 0.075 | | |
| B-1 | 0.012 | 19% | +4% |
| Acryloid 144 | 0.088 | | |

EXAMPLE 2

A waxy oil identical to that of Example 1 was dewaxed in a bench scale DILCHILL unit. This comprised a cylindrical unit 6 inches in diameter and 3 inches high equipped with a turbine impeller. Initially, this unit was filled with warm feed, then slowly cooled. At about the cloud point of the feed, cold solvent (−29° C.) was injected while the turbine was rotated at about 1000 rpm so that excess liquid overflowed and was removed. The rate of cold solvent addition was adjusted to match a target temperature/time profile typically in the range 1°-1.5° C./min. The dewaxing aids were again used in an "as received" form.

The first dewaxing aid component B-1 was added to the waxy feed at 55° C. with a treat rate of 0.025% on feed. The mixture was then chilled to 0° C. by the dilution chilling process. The solvent employed was 45/55 methylethyl ketone/methylisobutyl ketone.

The second dewaxing aid component (Acryloid 144 in this example) was then added to the waxy slurry at 0° C. with a treat rate of 0.075% on feed. The slurry was then chilled to filtration temperature (−10° C.) in the scraped surface chiller described in Example 1. The use of dewaxing aids led to a 12% increase in filter rate as compared to a similar chilling sequence using no dewaxing aid.

EXAMPLE 3

A waxy oil distillate identical to that of Example 1 was treated with a series of dewaxing aids under the experimental conditions of Example 1. Dewaxing aid treat levels of 0.1 and 0.4 wt.% (on an "as received" basis) were used. Th dewaxing aids tested were 3/1 mixtures of Acryloid 144/B-1, Acryloid 144/B-2, Acryloid 150/B-1 and Acryloid 150/B-2. The results of this Example 3 are summarized in Table II.

TABLE II

EFFECT OF DEWAXING AIDS IN KETONE DEWAXING OF 600N DISTILLATE
Solvent: MEK/MIBK
Process: Incremental Dilution

| Dewaxing Aid | Increase in Feed Filter Rate, % With a Treat Rate of 0.1 wt. % on Feed (wt. % as received) | With a Treat Rate of 0.4 wt. % on Feed (wt. % as received) |
|---|---|---|
| 3/1, Acryloid 144/B-1 | 23 | 37 |
| 3/1, Acryloid 144/B-2 | 6 | 25 |
| 3/1, Acryloid 150/B-1 | 12 | 16 |
| 3/1, Acryloid 150/B-2 | 0 | 15 |

The above demonstrates the superiority of the combinations Acryloid 144/B-1 and Acryloid 150/B-1, both combinations falling within the scope of the components recited in this specification, for solvent dewaxing distillates at low dewaxing aid treat dose levels.

EXAMPLE 4

Tests on Bright Stock

A Bright Stock residual waxy oil with a viscosity of 32 cSt at 100° C. was dewaxed in a bench-scale vertical scraper. It comprised a 13 cm ID steel cylinder which was 30 cm high. The walls were scraped by two vertical aluminum blades which were attached to a central shaft rotating at 28 rpm. The chilling rate of the scraper contents was about 1.6° C./minute.

The dewaxing aid combination to be tested (which has already been mixed) was added to the waxy feed to give the specified treat rate at about 70° C. The treated feed was then mixed with the predilution solvent and introduced into the scraper. The mixture was then chilled progressively and the solvent increments were added at appropriate temperatures. When the filtration temperature (about −23° C.) was reached, the scraper was removed and the filtration performance of the wax slurry was measured with a small vacuum leaf filter at a vacuum of 12 in Hg.

The solvent used in this example was a 50/50 mixture of methyl ethyl ketone and toluene. The dilution ratio at filtration was 2.7 volumes of solvent per volume of waxy feed.

Dewaxing aid treat levels of 0.05 and 0.4 wt.% (on an "as received" basis) were used. The dewaxing aids tested were 3/1 mixtures of Acryloid 144/B-1, Acryloid 144/B-2, Acryloid 150/B-1 and Acryloid 150/B-2. The results of this Example 4 are summarized in Table III. Embodiment within the scope of the present invention are identified by *. Embodiment Z is the subject of co-pending application OP-2855 filed even date herewith in the names of Lloyd E. Reid and David A. Gudelis.

TABLE III

EFFECT OF DEWAXING AIDS IN KETONE DEWAXING OF BRIGHT STOCK
Solvent: MEK/Toluene
Process: Total Predilution

| Dewaxing Aid | Increase in Feed Filter Rate, % | |
|---|---|---|
| | With a Treat Rate of 0.05 wt. % on Feed (wt. % as received) | With a Treat Rate of 0.4 wt. % on Feed (wt. % as received) |
| 3/1, Acryloid 150/B-2(Z) | 60 | — |
| 3/1, Acryloid 144/B-1* | 44 | 100 |
| 3/1, Acryloid 144/B-2 | — | 15 |
| 3/1, Acryloid 150/B-1 | — | 0 |

What is claimed is:

1. A solvent dewaxing process comprising mixing a waxy hydrocarbon oil distillate with dewaxing solvent and a dewaxing aid wherein said dewaxing aid comprises a mixture of:

A. poly alkyl (meth-) acrylate polymer; and

B. polydialkylfumarate/vinyl acetate copolymer wherein the pendent alkyl side chain groups are of from 16–30 carbons in length but are predominantly $C_{22}$; and C. chilling said oil/dewaxing solvent/dewaxing aid mixture to form a slurry comprising solid particles of wax and a solution of dewaxed oil and dewaxing solvent and separating said wax from said dewaxed oil solution.

2. The process of claim 1 wherein said poly alkyl (meth-) acrylate polymer is an ester of aliphatic alcohols of 10–22 carbons in length with acrylic or methacrylic acid.

3. The process of claim 1 or 2 wherein said poly alkyl (meth-) acrylate polymer is an ester of aliphatic alcohols of 12–18 carbons in length with methacrylic acid and said polymer has a number average molecular weight of greater than about 5,000 and wherein said polydialkylfumarate/vinyl acetate copolymer has a number average molecular weight of about 1,000 to 100,000.

4. The process of claim 1 or 2 wherein said dewaxing aid is employed at a dose level ranging from about 0.01 to 1.0 wt.% active ingredient.

5. The process of claim 3 wherein said dewaxing aid is employed at a dose level ranging from about 0.01 to 1.0 wt.% active ingredient.

6. The process of claim 4 wherein components (a) and (b) constituting the dewaxing aid are used in a weight ratio to each other ranging from about 100/1 to 1/5 of (a)/(b).

7. The process of claim 5 wherein components (a) and (b) constituting the dewaxing aid are used in a weight ratio to each other ranging from about 8/1 to 1/4 of (a)/(b).

8. The process of claim 6 wherein said dewaxing solvent is (1) a $C_3$–$C_6$ ketone and mixtures thereof; (2) aromatic hydrocarbons; (3) mixtures of ketones and aromatic hydrocarbons; (4) halogenated hydrocarbons; (5) N-alkylpyrrolidones; (6) mixtures of acetone and methylene chloride.

9. The process of claim 7 wherein said dewaxing solvent is (1) a $C_3$–$C_6$ ketone and mixtures thereof; (2) aromatic hydrocarbons; (3) mixtures of ketones and aromatic hydrocarbons; (4) halogenated hydrocarbons; (5) N-alkylpyrrolidones; (6) mixtures of acetone and methylene chloride.

10. The process of claim 9 wherein said poly alkyl (meth-) acrylate polymer selected from the group of methacrylate polymers having an average side chain of predominantly $C_{16}$–$C_{18}$ in length (>50% $C_{16}$ and higher), having an average side chain of predominantly $C_{14}$ and lower in length (>50% $C_{14}$ and lower) and wherein the poly dialkylfumarate/vinyl acetate copolymer is a behenylfumarate/vinyl acetate copolymer having an average pendent side chain length of predominantly $C_{22}$ (>50% $C_{22}$).

11. A solvent dewaxing process comprising mixing a waxy hydrocarbon oil bright stock with dewaxing solvent and dewaxing aid wherein said dewaxing aid comprises a mixture of:

A. a methacrylic ester copolymer wherein the pendent side chain group length thereof ranges between 10–22 carbons but is predominantly (>50%) $C_{16}$ and higher; and B. poly dialkylfumarate/vinyl acetate copolymer wherein the pendent alkyl side chain groups are of from 16 to 30 carbons in length but are predominantly (>50%) $C_{22}$.

12. The process of claim 11 wherein component (a) has a number average molecular weight of greater than about 5,000 and wherein component (b) has a number average molecular weight of about 1,000 to 100,000, wherein the combination is used at a dose level ranging from about 0.01 to 1.0 wt.% and wherein components (a) and (b) are used in a weight ratio to each other ranging from about 100/1 to 1/5 (a) to (b).

13. The process of claim 12 wherein said dewaxing solvent is (1) a $C_3$–$C_6$ ketone and mixtures thereof; (2) aromatic hydrocarbons; (3) mixtures of ketones and aromatic hydrocarbons; (4) halogenated hydrocarbons; (5) N-alkylpyrrolidones; (6) mixtures of acetone and methylene chloride.

* * * * *